US011589158B2

(12) United States Patent
Ukai

(10) Patent No.: US 11,589,158 B2
(45) Date of Patent: Feb. 21, 2023

(54) MICROPHONE ARRAY SYSTEM

(71) Applicant: Yamaha Corporation, Hamamatsu (JP)

(72) Inventor: Satoshi Ukai, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/449,681

(22) Filed: Oct. 1, 2021

(65) Prior Publication Data

US 2022/0109928 A1 Apr. 7, 2022

(30) Foreign Application Priority Data

Oct. 7, 2020 (JP) ..... JP2020-169748

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01)

(58) Field of Classification Search
CPC ..... H04R 3/005; H04R 1/326
USPC ..... 381/56, 58, 91, 92
See application file for complete search history.

(56) References Cited

U.S. PATENT DOCUMENTS 9,966,059 B1 5/2018 Ayrapetian et al.
2007/0172079 A1* 7/2007 Christoph ..... H04R 3/005 381/92
2012/0076316 A1 3/2012 Zhu et al.
2012/0327115 A1* 12/2012 Chhetri ..... H04R 3/005 345/633
2021/0058702 A1* 2/2021 Shumard ..... H04R 3/005

FOREIGN PATENT DOCUMENTS

EP 1 524 879 A1 4/2005
JP 2018-515028 A 6/2018
WO WO 2016/176429 A2 11/2016

OTHER PUBLICATIONS

Extended European Search Report issued in European Application No. 21201059.9 dated Feb. 28, 2022 (7 pages).

* cited by examiner

*Primary Examiner* — William A Jerez Lora
(74) *Attorney, Agent, or Firm* — Crowell & Moring LLP

(57) ABSTRACT

A microphone array system includes first microphones disposed along a first axis, second microphones disposed at equal intervals of a first distance from the first axis along a second axis orthogonal to the first axis, a beamforming processor that performs beamforming by filtering and combining audio signals from microphones, and, when the second microphones are projected onto the first axis, the first microphones and projected second microphones are disposed at equal intervals of a second distance, a distance between two microphones disposed at opposite ends, among the first microphones and the projected second microphones arranged along the first axis when the second microphones are projected onto the first axis, is larger than a distance between two microphones disposed at opposite ends, among the first microphones and the projected second microphones arranged along the second axis when the first microphones are projected onto the second axis.

7 Claims, 5 Drawing Sheets

MICROPHONE ARRAY SYSTEM

CROSS REFERENCE TO RELATED APPLICATIONS

This Nonprovisional application claims priority under 35 U.S.C. § 119(a) on Patent Application No. 2020-169748 filed in Japan on Oct. 7, 2020, the entire contents of which are hereby incorporated by reference.

BACKGROUND

Technical Field

The present disclosure relates to a microphone array system including a plurality of microphones.

Background Information

National Publication of International Patent Application No. 2018-515028 discloses a microphone array system that includes a plurality of microphones disposed concentrically and performs beamsteering. The microphone array system of National Publication of International Patent Application No. 2018-515028 includes tens of microphones. The microphone array system of National Publication of International Patent Application No. 2018-515028 includes a large number of microphones to provide a uniform SN ratio from a low frequency band (10 kHz or less, for example) to a high frequency band (10 kHz or more, for example).

However, with a small number of microphones (less than 10, for example), it is difficult to ensure an SN ratio in the low frequency band.

SUMMARY

In view of the foregoing, an object of the present disclosure is to provide a microphone array system that is able to improve an SN ratio in a low frequency band, even with a small number of microphones.

A microphone array system includes a plurality of first microphones disposed along a first axis, a plurality of second microphones disposed at equal intervals of a first distance from the first axis, along a second axis orthogonal to the first axis, a beamforming processor that performs beamforming by filtering and combining audio signals from the plurality of first microphones and the plurality of second microphones, and, when the plurality of second microphones are projected onto the first axis, the plurality of first microphones and a plurality of projected second microphones are disposed at equal intervals of a second distance, a distance between two microphones disposed at opposite ends, among the plurality of first microphones and the plurality of projected second microphones arranged along the first axis when the plurality of second microphones are projected onto the first axis, is larger than a distance between two microphones disposed at opposite ends, between the opposite ends of the plurality of first microphones and the plurality of projected second microphones arranged along the second axis when the plurality of first microphones are projected onto the second axis.

A microphone array system is able to improve an SN ratio in a low frequency band even with a small number of microphones.

DETAILED DESCRIPTION

Figure 1:
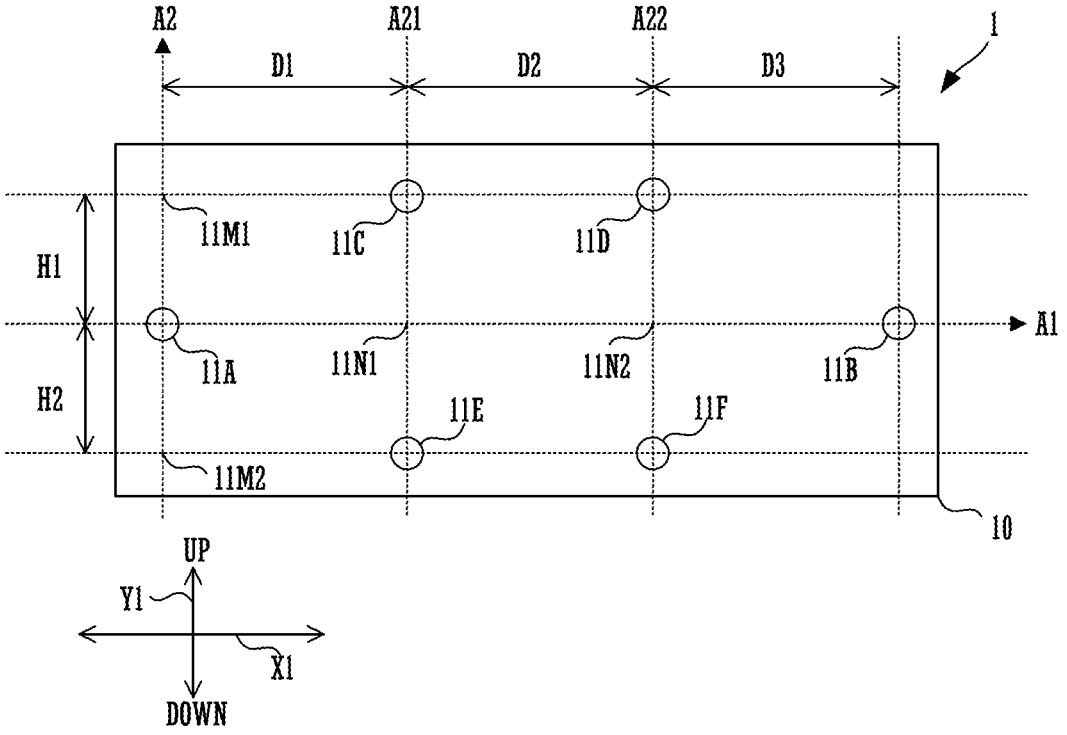
FIG. 1 is a front view of a microphone array system 1.

FIG. 1 is a front view of a microphone array system 1. The microphone array system 1 includes a plurality of microphones in front of a housing 10. The microphone array system 1 according to the present embodiment includes six microphones of a microphone 11A, a microphone 11B, a microphone 11C, a microphone 11D, a microphone 11E, and a microphone 11F.

The housing 10 has a rectangular parallelepiped shape with a small depth, as an example. However, the shape of the housing 10 can be any shape that allows a plurality of microphones to be disposed in front.

The housing 10 shown in FIG. 1 has a shape that is long in a left-right direction (a horizontal direction) X1 and is short in an up-down direction Y1 (a vertical direction Y1). The housing 10 is disposed above or below a display (not shown), for example. The microphone array system 1 collects the voice of a talker present in front of the display (not shown) by using the plurality of microphones disposed in front of the housing 10.

Figure 2:
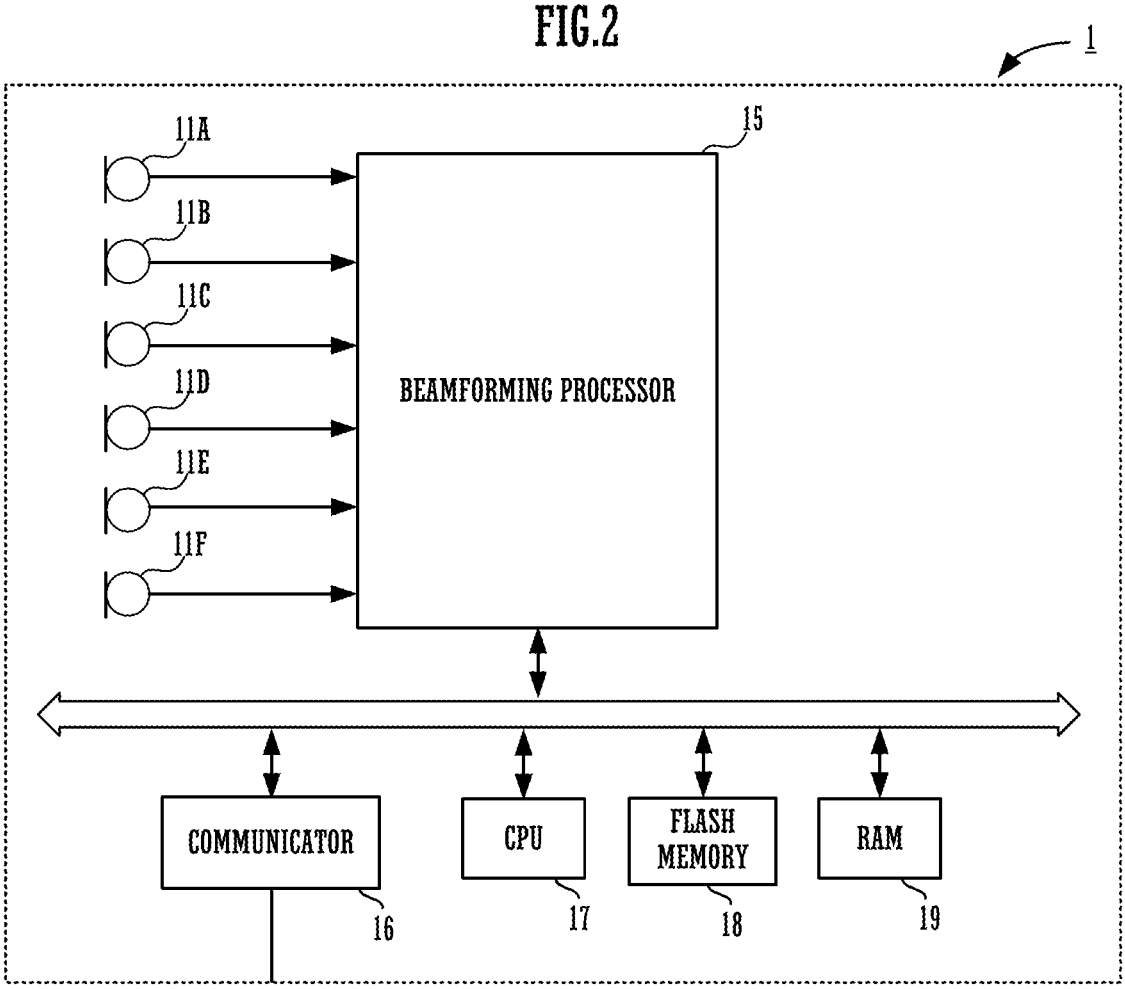
FIG. 2 is a block diagram of the microphone array system 1.

FIG. 2 is a block diagram showing a configuration of the microphone array system 1. The microphone array system 1, in addition to the six microphones of the microphone 11A, the microphone 11B, the microphone 11C, the microphone 11D, the microphone 11E, and the microphone 11F, further includes a beamforming processor 15, a communicator 16, a CPU 17, a flash memory 18, and a RAM 19.

The CPU 17 is a controller that controls an operation of the microphone array system 1. The CPU 17 reads and implements a predetermined program stored in the flash memory 18 being a storage medium to the RAM 19 and performs various types of operations. For example, the CPU 17 controls the beamforming processor 15 by the program.

It is to be noted that the program that the CPU 17 reads does not need to be stored in the flash memory 18 in the own device. For example, the program may be stored in a storage medium of an external device such as a server. In such a case, the CPU 17 may read the program each time from the server to the RAM 19 and may execute the program.

The beamforming processor 15 includes a DSP (a Digital Signal Processor). The beamforming processor 15 obtains an audio signal from the microphone 11A, the microphone 11B, the microphone 11C, the microphone 11D, the microphone 11E, and the microphone 11F. The beamforming processor 15 performs beamforming by performing filter processing on each audio signal obtained from the microphone 11A, the microphone 11B, the microphone 11C, the microphone 11D, the microphone 11E, and the microphone 11F and combining the audio signals. The signal processing according to the beamforming can be any processing such as the Delay Sum type, the Griffiths Jim type, the Henry cox type, the Sidelobe Canceller type, or the Frost Adaptive Beamformer.

The CPU 17 determines the content of the filter processing of the beamforming processor 15, and controls the beamforming of the beamforming processor 15. For example, the CPU 17 controls the beamforming processor 15 to detect a position of a talker and to direct a beam to the position of a detected talker. The beamforming processor 15 obtains the voice of a talker with a high SN ratio by performing beamforming.

The communicator 16 sends the audio signal on which the beamforming has been performed by the beamforming processor 15 to a different device. The different device is an information processor installed in a remote place, for example. As a result, the microphone array system 1 sends the voice of a talker to an information processor in a remote place. In such a case, the microphone array system 1 functions as one component of a communication system for performing voice conversation with a remote place.

In the microphone array system 1, as shown in FIG. 1, the microphone 11A and the microphone 11B are disposed on a first axis A1 in the horizontal direction X1. In addition, in the microphone array system 1, the microphone 11C and the microphone 11E are disposed along a second axis A21 in the vertical (perpendicular) direction Y1 orthogonal to the first axis A1. In addition, in the microphone array system 1, the microphone 11E and the microphone 11F are disposed along a second axis A22 in the vertical (perpendicular) direction Y1 orthogonal to the first axis A1.

Each of the microphone 11C and the microphone 11D is disposed at a position away from the first axis A1 by a distance H1 in an upward direction. In addition, each of the microphone 11E and the microphone 11F is disposed at a position away from the first axis A1 by a distance H2 in a downward direction. A first distance H1 and a first distance H2 are the same distance.

In other words, the microphone 11A and the microphone 11B configure a plurality of first microphones disposed along the first axis A1. The microphone 11C, the microphone 11D, the microphone 11E, and the microphone 11F configure a plurality of second microphones disposed at equal intervals of the first distance H1 (=H2) from the first axis A1. It is to be noted that the equal intervals according to the present embodiment are not only the exact same intervals. For example, the equal intervals may include intervals with an error of about ±5%.

Furthermore, when the microphone 11C, the microphone 11D, the microphone 11E, and the microphone 11F are projected onto the first axis A1, all the microphones on the first axis A1 are arranged at equal intervals. The microphone 11C and the microphone 11E, when being projected onto the first axis A1, configure a virtual microphone 11N1 on the first axis A1. The microphone 11D and the microphone 11F, when being projected onto the first axis A1, configure a virtual microphone 11N2 on the first axis A1. The microphone 11A, the virtual microphone 11N1, the virtual microphone 11N2, and the microphone 11B are disposed at equal intervals of a second distance. A second distance D1 between the virtual microphone 11N1 and the microphone 11A, a second distance D2 between the virtual microphone 11N2 and the virtual microphone 11N1, and a second distance D3 between the microphone 11B and the virtual microphone 11N2 are all the same distance.

The microphone array configured by the microphone 11A, the microphone 11B, the microphone 11C, the microphone 11D, the microphone 11E, and the microphone 11F, in beamforming in the horizontal direction X1, is equivalent to using audio signals of the four microphones (the microphone 11A, the virtual microphone 11N1, the virtual microphone 11N2, and the microphone 11B) arranged on the first axis A1.

These four microphones (the microphone 11A, the virtual microphone 11N1, the virtual microphone 11N2, and the microphone 11B) are arrayed at equal intervals of the second distance D1 (=D2=D3) along the first axis A1. When beamforming is performed by four microphones arrayed at equal intervals, ripples appearing due to the Gibbs phenomenon are larger than when beamforming is performed by microphones arrayed at different intervals. Accordingly, the interaction (resonance) of the four microphones causes the SN ratio to be higher or lower at a specific frequency.

Figure 3:
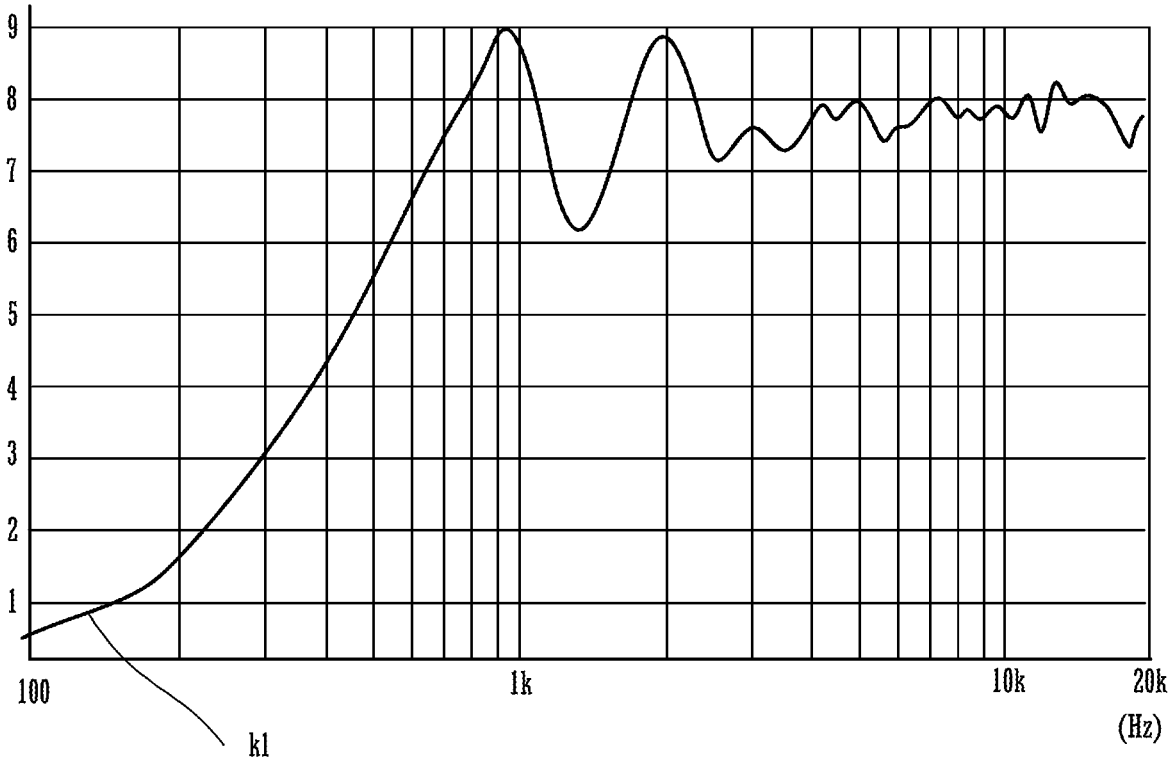
FIG. 3 shows a directivity coefficient of the microphone array system 1.
Figure 4:
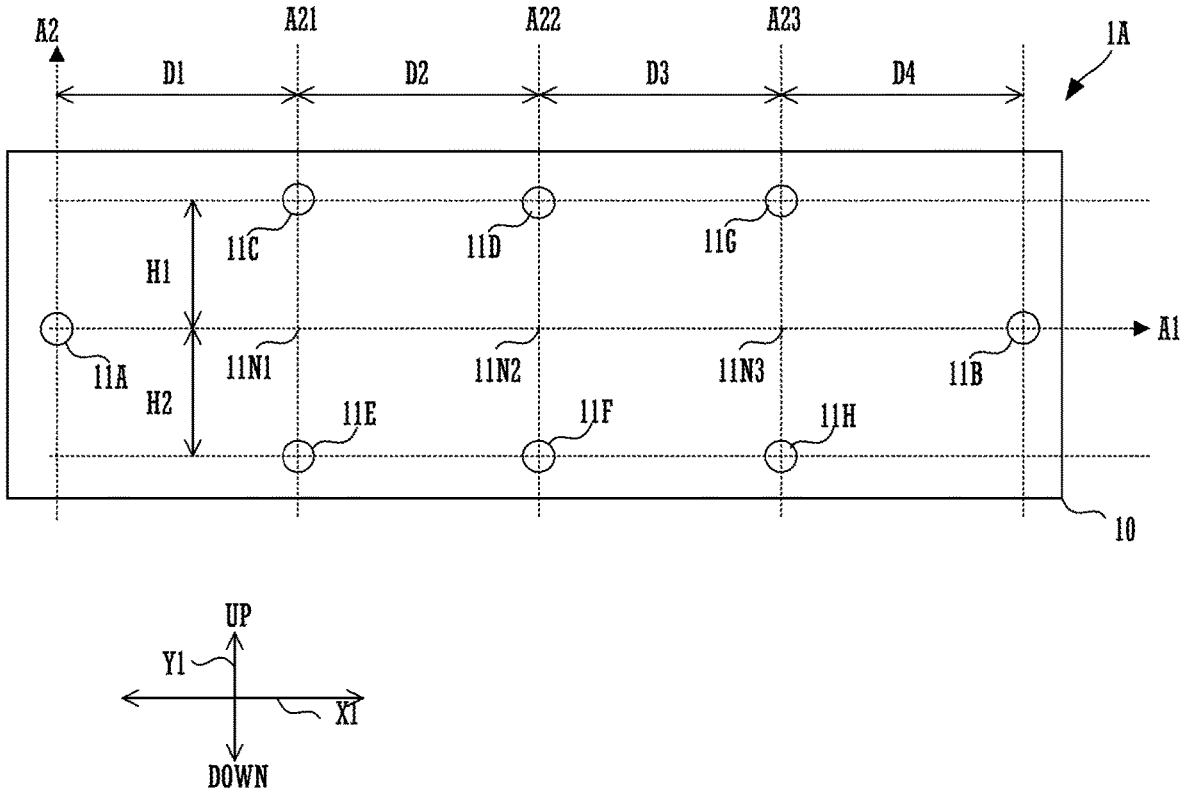
FIG. 4 is a front view of a microphone array system 1A including eight microphones.

FIG. 3 shows a directivity coefficient kl of the microphone array system 1. In the graph shown in FIG. 3, the horizontal axis represents a frequency and the vertical axis represents a directivity coefficient. The directivity coefficient kl corresponds to a relative SN ratio in a case in which the six microphones of the microphone 11A, the microphone 11B, the microphone 11C, the microphone 11D, the microphone 11E, and the microphone 11F are combined and assumed to be one single microphone with respect to a single microphone (the microphone 11A, for example).

The microphone array system 1 produces a peak in the SN ratio at a specific frequency that depends on a distance between microphones due to the interaction between the microphone 11A and the virtual microphone 11N1, the virtual microphone 11N1 and the virtual microphone 11N2, and the microphone 11B and the virtual microphone 11N2. The peak is produced periodically at a plurality of frequencies in order from the lowest frequency.

The example in FIG. 3 shows directivity characteristics in a case in which second distances (D1+D2+D3) between the microphone 11A and the microphone 11B disposed at opposite ends is about 1 m. In such a case, each of the second distances D1, D2, D3 is set to about 33 cm. Accordingly, as shown in FIG. 3, a peak is produced at about 1 kHz at the lowest frequency. In addition, in a frequency band higher than 1 kHz, a peak is produced periodically at a plurality of frequencies.

The peak at the lowest frequency (hereinafter referred to as the lowest peak) varies with the distance between the microphone 11A and the microphone 11B, that is, the second distance D1, D2, D3. The frequency of the lowest peak is lower as the second distance D1, D2, D3 is larger. For example, when the distance between the microphone 11A and the microphone 11B is about 10 m, the frequency of the lowest peak is about 100 Hz. In addition, the frequency of the lowest peak is higher as the second distance D1, D2, D3 is smaller. For example, when the distance between the microphone 11A and the microphone 11B is about 10 cm, the frequency of the lowest peak is about 10 kHz.

Normally, interior noise, reverberation, and an echo have a high level in a low frequency band of 10 kHz or less. Particularly, interior noise, reverberation, and an echo have a higher level in a lower frequency band such as 1 kHz or less. Accordingly, for beamforming, it is important to ensure a higher SN ratio in a lower frequency band of 10 kHz or less. The microphone array system 1 according to the present embodiment, even with a small number (six) of microphones, shows a very high SN ratio in the low frequency of 1 kHz in which the influence of interior noise, reverberation, and an echo is large. The microphone array system 1 according to the present embodiment, even with a small number of microphones, is able to improve the SN ratio in the low frequency band. Accordingly, the microphone array system 1 is able to reduce the influence of interior noise, reverberation, and an echo and provide a good directivity.

In addition, in the microphone array system 1 according to the present embodiment, a plurality of microphones are disposed not only in the horizontal direction X1 but also in the vertical (perpendicular) direction Y1. When the microphone 11C, the microphone 11D, the microphone 11E, and the microphone 11F are projected onto a second axis A2, a virtual microphone 11M1 and a virtual microphone 11M2 are configured on the second axis A2. The microphone 11A, the virtual microphone 11M1, and the virtual microphone 11M2 on the second axis A2 are arranged at equal intervals. Therefore, the microphone array system 1 produces a peak in the SN ratio at a specific frequency due to the interaction of a plurality of microphones in the vertical direction Y1 as well as in the horizontal direction X1. Accordingly, the microphone array system 1 according to the present embodiment is able to perform beamforming also in the vertical direction Y1.

As described above, the microphone array system 1 is disposed above or below the display (not shown), and collects the voice of a talker present in front of the display (not shown). The talker is present at a height of about 1 m to about 2 m from a floor in the up-down direction Y1, and is rarely present at a position far beyond the range of 1 m to 2 m. On the other hand, the talker is present at various positions in the horizontal direction X1 in many cases. For example, a talker may be right in front of the display (not shown) or talkers may be at positions apart from the right and left sides.

In contrast, in the microphone array system 1, a distance (a distance between the microphone 11A and the microphone 11B) between opposite ends of the microphones arranged along the first axis A1 in the horizontal direction X1 is larger than a distance (a distance between the microphone 11C and the microphone 11E, for example) between opposite ends of the microphones arranged along each of the second axis A21 and the second axis A22 in the vertical direction Y1. As a result, the microphone array system 1 is able to improve the performance of beamforming in the horizontal direction X1 over the vertical direction Y1, and collect the voice of talkers present at various positions in the horizontal direction X1.

In addition, the number of microphones (the microphone 11A, the virtual microphone 11N1, the virtual microphone 11N2, and the microphone 11B) arranged along the first axis A1 in the horizontal direction X1 in the microphone array system 1 is four. The number of microphones (the microphone 11A, the virtual microphone 11M1, the virtual microphone 11M2) arranged along the second axis A2 in the vertical direction Y1 is three. In other words, the number of microphones arranged along the first axis A1 in the horizontal direction X1 is larger than the number of microphones arranged along the second axis A2 in the vertical direction Y1. As a result, the microphone array system 1 is able to form a sharper beam in the horizontal direction X1 than in the vertical direction Y1. Accordingly, the microphone array system 1, even when a plurality of talkers are present, is able to separate and collect the voice for each talker with high accuracy.

It is to be noted that, in the microphone array system 1 shown in FIG. 1, the second distance (D1, D2, D3) is larger than the first distance (H1, H2). However, the second distance (D1, D2, D3) may be the same as the first distance (H1, H2).

In addition, the microphone array system 1 of FIG. 1 shows an example in which six microphones are provided. However, the number of microphones is not limited to six. For example, FIG. is a front view of a microphone array system 1A including eight microphones. The same reference numerals are used to refer to components common to FIG. 1, and the description will be omitted.

The microphone array system 1A further includes a microphone 11G and a microphone 11H. The microphone 11G is disposed at a position away from the first axis A1 by the first distance H1 in the upward direction, along a second axis A23. The microphone 11H is disposed at a position away from the first axis A1 by the first distance H2 in the downward direction. In other words, the microphone 11G and the microphone 11H configure a plurality of second microphones disposed at equal intervals of the first distance H1 (=H2) from the first axis A1.

The microphone 11G and the microphone 11H, when being projected onto the first axis A1, configure a virtual microphone 11N3 on the first axis A1. When the microphone 11G and the microphone 11H are projected onto the first axis A1, all the microphones on the first axis are arranged at equal intervals. A second distance D1 between the virtual microphone 11N1 and the microphone 11A, a second distance D2 between the virtual microphone 11N2 and the virtual microphone 11N1, a second distance D3 between the virtual microphone 11N3 and the virtual microphone 11N2, and a second distance D4 between the microphone 11B and the virtual microphone 11N3 are all the same.

In such a case as well, as with the microphone array system 1 of FIG. 1, a peak is produced in the SN ratio at a specific frequency due to the interaction of a plurality of microphones arranged in the horizontal direction X1. Accordingly, the microphone array system LA, even with a small number (eight) of microphones, is able to improve the SN ratio in the low frequency band. The microphone array system LA, with more microphones arranged in the horizontal direction X1 than the microphone array system 1 of FIG. 1, is able to improve the SN ratio in the lower frequency band.

Figure 5:
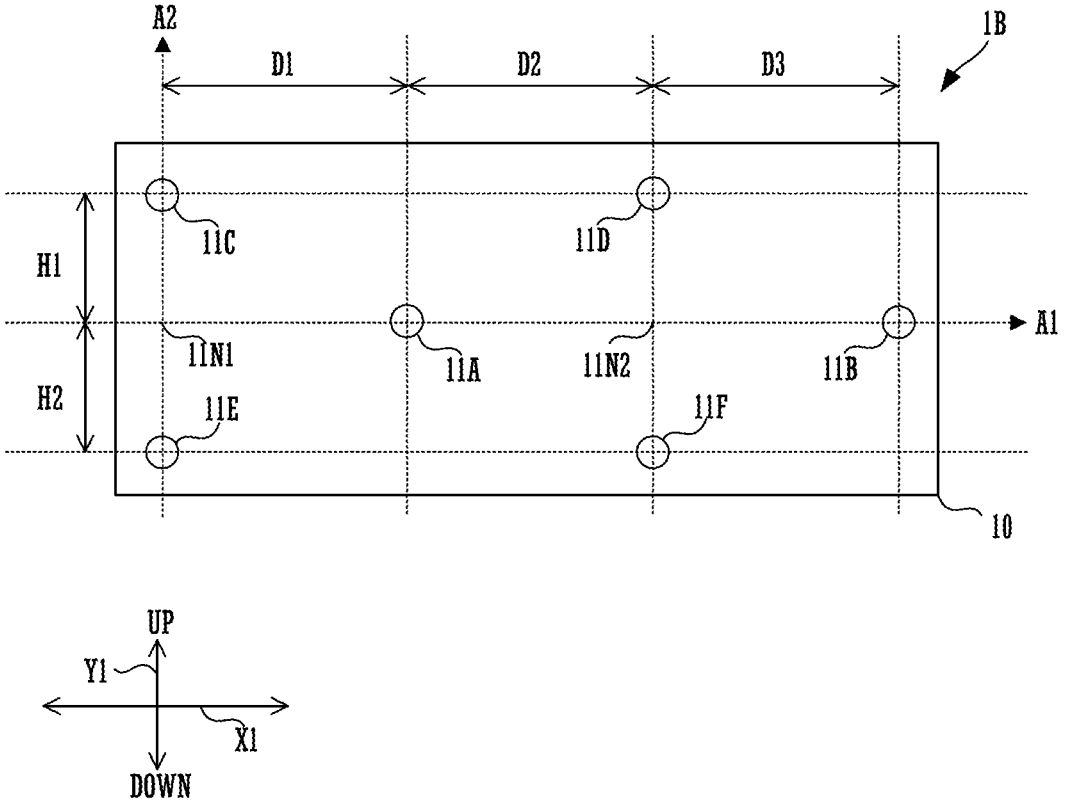
FIG. 5 is a front view of a microphone array system 1B in which a first microphone is not disposed at opposite ends.

In addition, the first microphone (the microphone 11A and the microphone 11B, for example) disposed on the first axis A1 does not need to be disposed at opposite ends. For example, FIG. 5 is a front view of a microphone array system 1B in which the first microphone (the microphone 11A and the microphone 11B) is not disposed at opposite ends. The same reference numerals are used to refer to components common to FIG. 1, and the description will be omitted.

In the microphone array system 1B, in a front view, the microphone 11C and the microphone 11E are disposed at a left end, and the microphone 11A is disposed between the virtual microphone 11N1 and the virtual microphone 11N2. Other configurations are the same as the configurations of the microphone array system 1 of FIG. 1.

In such a case as well, when the microphone 11C, the microphone 11D, the microphone 11E, and the microphone 11F are projected onto the first axis A1, all the microphones on the first axis A1 are arranged at equal intervals. Accordingly, the microphone array system 1B, as with the microphone array system 1 of FIG. 1, is able to improve the SN ratio in the low frequency band, even with a small number (six) of microphones.

The description of the present embodiments is illustrative in all points and should not be construed to limit the present disclosure. The scope of the present disclosure is defined not by the foregoing embodiments but by the following claims for patent. Further, the scope of the present disclosure is intended to include all modifications within the scopes of the claims for patent and within the meanings and scopes of equivalents.

For example, the present embodiment shows an example in which the number of microphones is six or eight. However, the number of microphones may be ten or more.

However, the microphone array system according to the present embodiment is able to improve the SN ratio in the low frequency band even with a small number of microphones, and thus the number of microphones is able to be reduced so as to reduce the size of the housing, and the cost. Therefore, the number of microphones is preferably six or eight.

In addition, in the present embodiment, the plurality of first microphones (the microphone 11A and the microphone 11B) and the plurality of second microphones (the microphone 11C, the microphone 11D, the microphone 11E, and the microphone 11F) may be disposed so that each of the plurality of first microphones (the microphone 11A and the microphone 11B) and a plurality of virtual microphones obtained by projecting the second microphones onto the second axis may be arranged at equal intervals on the second axis. In such a case, for example, when the microphone 11C, the microphone 11D, the microphone 11E, and the microphone 11F are projected onto the second axis orthogonal to the first axis A1 at the position of the microphone 11B, the plurality of virtual microphones are configured on the second axis. The microphone 11B and the plurality of virtual microphones are arranged at equal intervals on the second axis.

What is claimed is:

1. A microphone array system comprising:

a plurality of first microphones disposed along a first axis;

a plurality of second microphones disposed at equal intervals of a first distance from the first axis, along a second axis orthogonal to the first axis; and a beamforming processor that performs beamforming by filtering and combining audio signals from the plurality of first microphones and the plurality of second microphones, wherein:

when the plurality of second microphones are projected onto the first axis, a plurality of first virtual microphones are formed along the first axis, such that the plurality of first microphones and the plurality of first virtual microphones are disposed at equal intervals of a second distance;

when the plurality of second microphones are projected onto the second axis, a plurality of second virtual microphones are formed along the second axis; and a third distance between two microphones disposed at opposite ends among the plurality of first microphones and the plurality of first virtual microphones arranged along the first axis when the plurality of second microphones are projected onto the first axis, is larger than a fourth distance between two microphones disposed at opposite ends among the plurality of first microphones and the plurality of second virtual microphones arranged along the second axis when the plurality of second microphones are projected onto the second axis.

2. The microphone array system according to claim 1, wherein a number of first microphones and first virtual microphones arranged along the first axis when the plurality of second microphones are projected onto the first axis, is larger than a number of second virtual microphones and first microphones arranged along the second axis when the plurality of second microphones are projected onto the second axis.

3. The microphone array system according to claim 1, wherein the second distance is larger than the first distance.

4. The microphone array system according to claim 1, wherein the first distance is equal to the second distance.

5. The microphone array system according to claim 1, wherein the distance between two microphones disposed at opposite ends among the plurality of first microphones and the plurality of first virtual microphones arranged along the first axis when the plurality of second microphones are projected onto the first axis, is 10 cm or more and 10 m or less.

6. The microphone array system according to claim 1, wherein a number of first microphones and second microphones is six or more in total.

7. The microphone array system according to claim 6, wherein the number of first microphones and second microphones is eight or less in total.

* * * * *